US007481617B2

(12) United States Patent
Hsu et al.

(10) Patent No.: US 7,481,617 B2
(45) Date of Patent: Jan. 27, 2009

(54) HEAT-DISSIPATING DEVICE

(75) Inventors: Wei-Chun Hsu, Taoyuan (TW); Shun-Chen Chang, Taoyuan (TW); Wen-Shi Huang, Taoyuan (TW); Hsiou-Chen Chang, Taoyuan (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 370 days.

(21) Appl. No.: 11/150,236

(22) Filed: Jun. 13, 2005

(65) Prior Publication Data

US 2005/0260073 A1 Nov. 24, 2005

Related U.S. Application Data

(63) Continuation-in-part of application No. 10/848,074, filed on May 19, 2004, now Pat. No. 7,241,110.

(30) Foreign Application Priority Data

Jun. 18, 2004 (TW) ..... 93117624 A

(51) Int. Cl.
*F04D 29/44* (2006.01)

(52) U.S. Cl. ..... 415/184; 415/199.6; 415/206; 415/211.2; 416/198 R

(58) Field of Classification Search ..... 415/199.6, 415/184, 204, 206, 214.1, 215.1
See application file for complete search history.

(56) References Cited

U.S. PATENT DOCUMENTS 3,407,995 A * 10/1968 Kinsworthy ..... 415/94
5,188,508 A 2/1993 Scott et al.
5,257,904 A * 11/1993 Sullivan ..... 415/214.1
5,982,064 A 11/1999 Umeda et al.
5,997,246 A * 12/1999 Humbad ..... 415/119
6,179,561 B1 1/2001 Horng
6,802,699 B2 * 10/2004 Mikami et al. ..... 415/206

FOREIGN PATENT DOCUMENTS

| | | | |
|---|---|---|---|
| CN | 1369671 | A | 9/2002 |
| CN | 2533304 | Y | 1/2003 |
| DE | 2 223 066 | | 11/1973 |
| DE | 2 223 066 | | 10/2003 |
| DE | 203 09 621 | U1 | 10/2003 |
| EP | 0 846 868 | A2 | 6/1998 |
| EP | 1 178 215 | A2 | 2/2002 |
| JP | 39-10991 | | 6/1964 |
| JP | 53-10402 | | 7/1976 |
| JP | 60-130114 | U | 7/1985 |
| JP | 61-078776 | U | 5/1986 |
| JP | 3038538 | U | 6/1997 |
| JP | 2001-182691 | A | 7/2001 |
| JP | 2002-257085 | A | 9/2002 |
| JP | 2003-206891 | A | 7/2003 |
| JP | 2004-01635 | A | 1/2004 |

* cited by examiner

*Primary Examiner*—Igor Kershteyn
(74) *Attorney, Agent, or Firm*—Birch, Stewart, Kolasch & Birch, LLP

(57) ABSTRACT

A heat-dissipating device includes a housing having at least one air inlet and at least one air outlet, and a rotor disposed in the housing, wherein the housing has a first extending part extending along an axial direction of the heat-dissipating device to form an axially compressed air passage inside the housing for enabling the airflow to smoothly flow in the air passage inside the frame thereof so as to enhance its performance.

20 Claims, 6 Drawing Sheets

HEAT-DISSIPATING DEVICE

FIELD OF THE INVENTION

The present invention is a continuation-in-part application of the parent application bearing Ser. No. 10/848,074 and filed on May 19, 2004 now U.S. Pat. No. 7,241,110. The present invention relates to a heat-dissipating device, and in particular to a high-pressure centrifugal fan with an axially compressed air passage.

DESCRIPTION OF THE RELATED ART

In FIG. 1A, a conventional blower 1 includes a frame 10, a motor 11, an impeller 12 and a cover 13. The frame 10 includes an opening 101 as an air outlet and the cover 13 has a circular opening 131 as an air inlet. The way from the air inlet to the air outlet constitutes an airflow passage. The motor 11 is disposed on a base 102 of the frame 10 to drive the impeller 12. The impeller 12 includes a hub 121, an annular plate 122, and a plurality of blades 123 disposed on the upper side and the lower side of the annular plate 122 and circumferentially disposed around the hub 121.

However, this conventional blower adopts a design of radially compressed air passage as shown in FIG. 1B, wherein the width of the airflow passage formed inside the frame is changed from the narrowest width W1 at the location A to the maximum width W2 at the air outlet 101. Therefore, the intaked airflow is compressed at the location A and then guided toward the air outlet 101 along the arrow direction R. However, because the height of the air passage in the axial direction are identical, it is impossible to compress the airflow in the axial direction.

SUMMARY OF THE INVENTION

An object of the present invention is to provide a heat-dissipating device with an axially compressed air passage.

Another object of the present invention is to provide a heat-dissipating device utilizing an axially compressed air passage for enabling the airflow to smoothly flow in the air passage inside the frame thereof so as to enhance its performance.

According to the present invention, the heat-dissipating device includes a housing having at least one air inlet and at least one air outlet, and a rotor disposed in the housing, wherein the housing has a first extending part extending along an axial direction of the heat-dissipating device to form an axially compressed air passage inside the housing.

Preferably, an axially extending depth of the first extending part is gradually increased from the air outlet to a position far away from the air outlet.

The housing further includes a second extending part axially extending corresponding to the first extending part to form a two-side axially compressed air passage inside the housing. An axially extending depth of the second extending part is gradually increased from the air outlet to a position far away from the air outlet. Preferably, an axially extending depth of the first or second extending part is gradually decreased to almost become zero near the air outlet.

Alternatively, the first and second extending parts are formed in a mirror image configuration in the axial direction. Preferably, the housing further comprises a radially compressed air passage inside the housing.

On the other hand, the rotor comprises a base, a hub, a first set of blades and a second set of blades. The first set of blades extends from a periphery of the hub to a surface of the base and the second set of blades is disposed on the base. The base, the hub, the first and second sets of blades can be integrally formed as a single unit.

Additionally, the housing further includes a first frame for accommodating the rotor therein, and a second frame coupled to the first frame, provided with the air inlet, and having a sidewall extending from a periphery of the air inlet to define an air-gathering chamber in the housing. The sidewall has a flange radially extending from one end thereof to define an entrance of the air-gathering chamber, and each of the blades has an end extending toward the entrance of the air-gathering chamber for guiding the airflow into the air-gathering chamber. The air-gathering chamber partially or completely overlaps an air passage through the rotor in height along an axis of the heat-dissipating device.

The second frame further comprises a plurality of air-guiding members disposed along the sidewall for increasing a blast pressure of airflow passing through the heat-dissipating device. In addition, the second frame has a support mounted inside the air inlet and the plurality of air-guiding members are arranged between the sidewall and the support. The plurality of air-guiding members can be shaped as strip, plate, curved, inclined or airfoil structures.

Additionally, the first frame has a bearing tube for allowing a first bearing to be disposed therein and the support of the second frame receives a second bearing so as to jointly support a shaft of the rotor with the first bearing.

BRIEF DESCRIPTION OF THE DRAWINGS

The present invention is more fully understood by reading the subsequent detailed description and examples with references made to the accompanying drawings, wherein.

DETAILED DESCRIPTION OF THE INVENTION

Figure 1A:
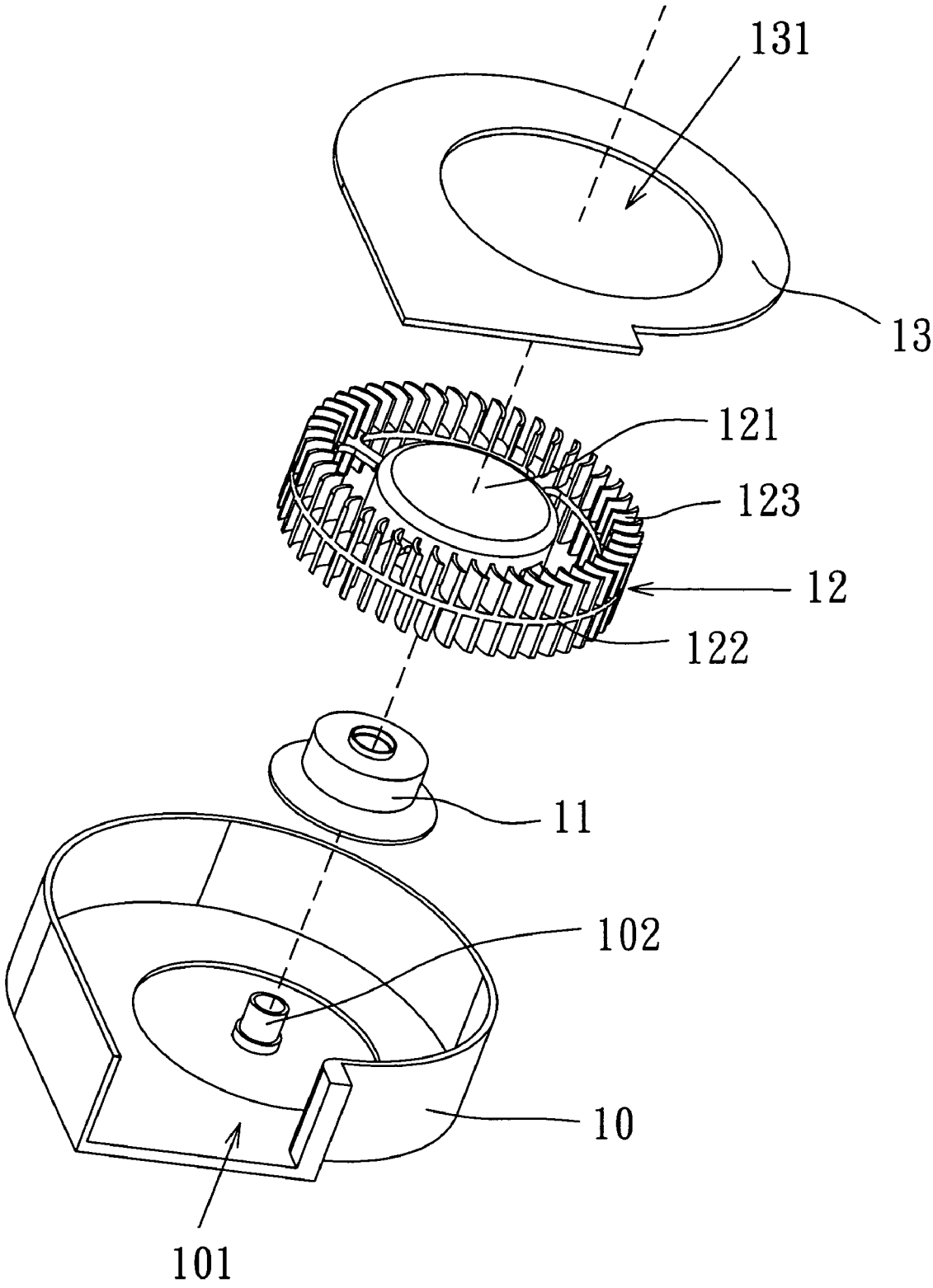
Fig. 1A(Prior Art)
FIG. 1A is an exploded view of a conventional blower.
Figure 1B:
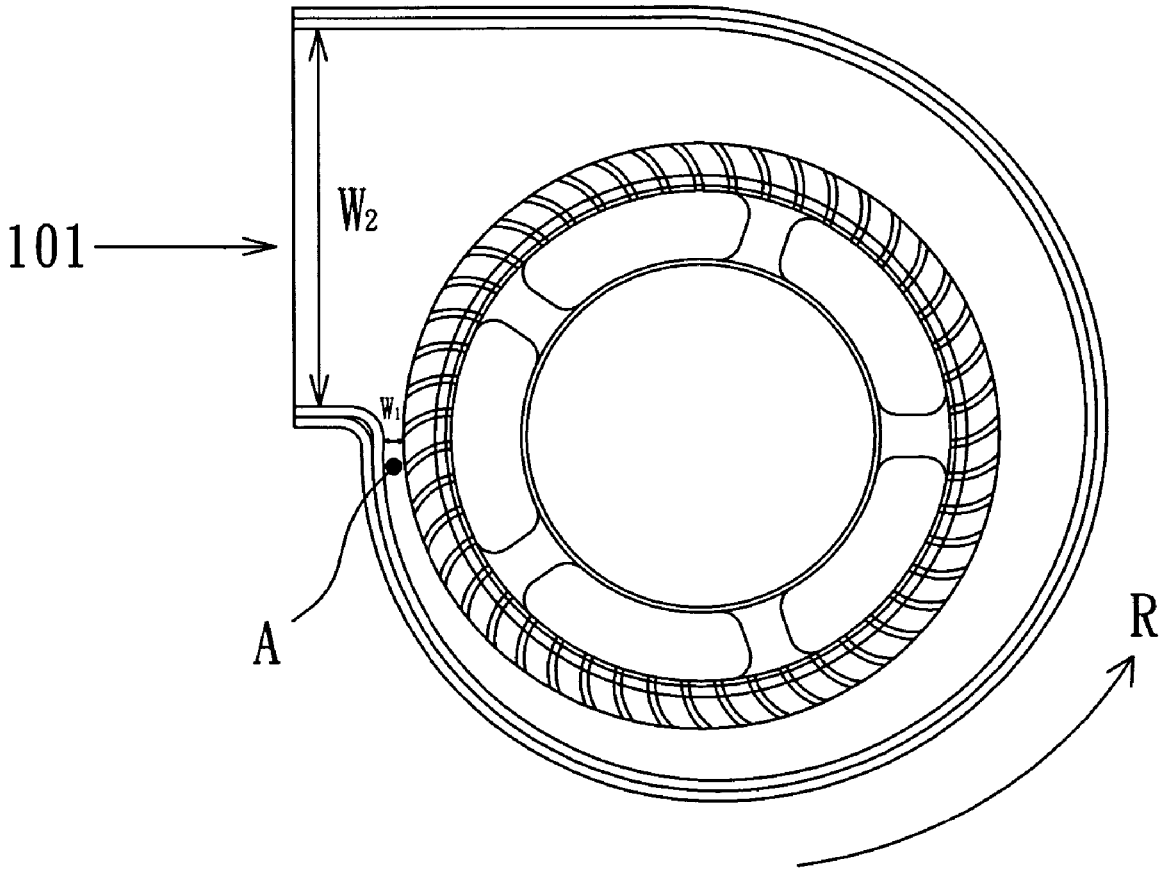
Fig. 1B(Prior Art)
FIG. 1B is a top view of a conventional blower shown in FIG. 1A after being assembled.
Figure 2A:
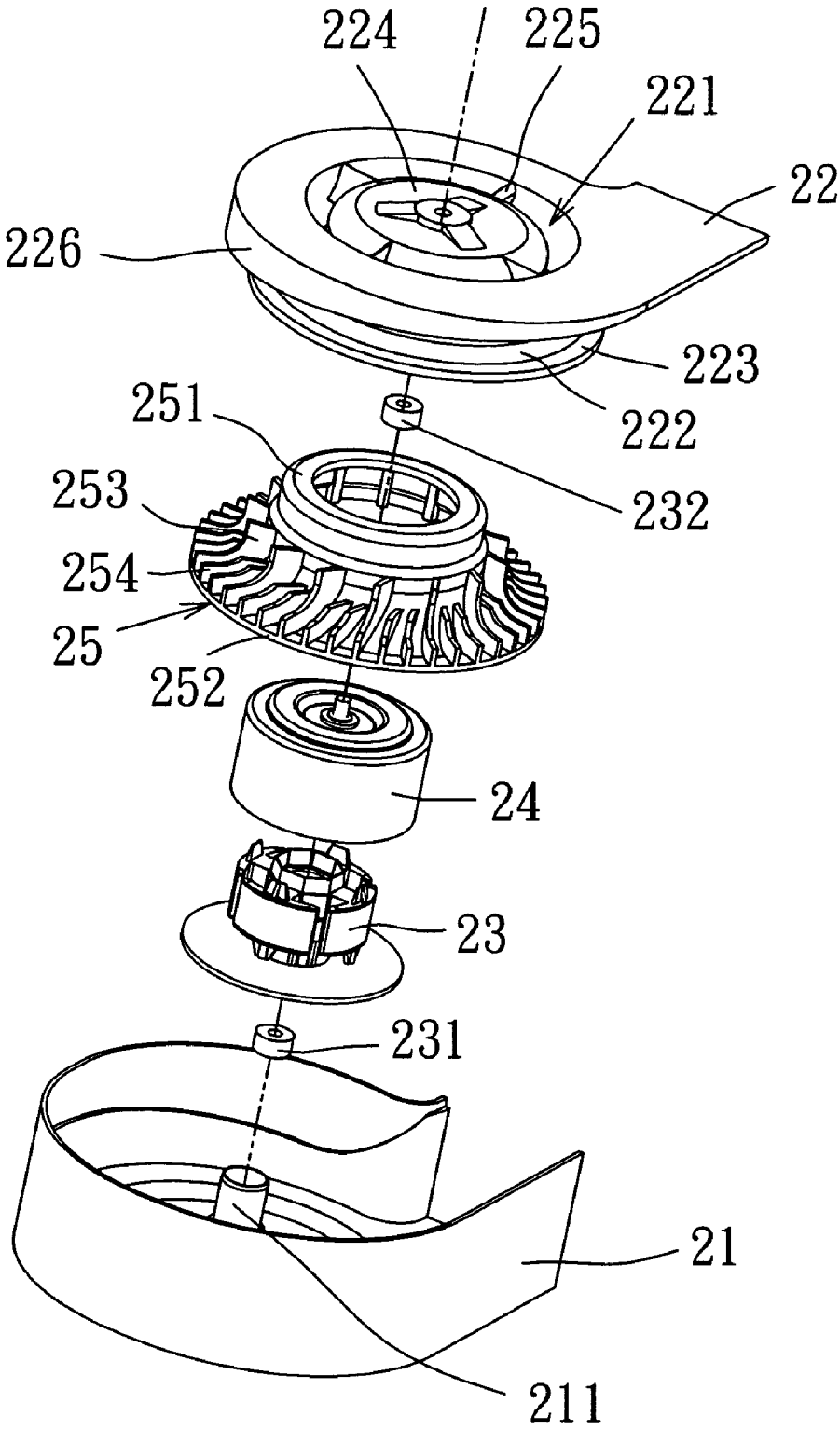
FIG. 2A is an exploded view of a heat-dissipating device according to an embodiment of the present invention.
Figure 2B:
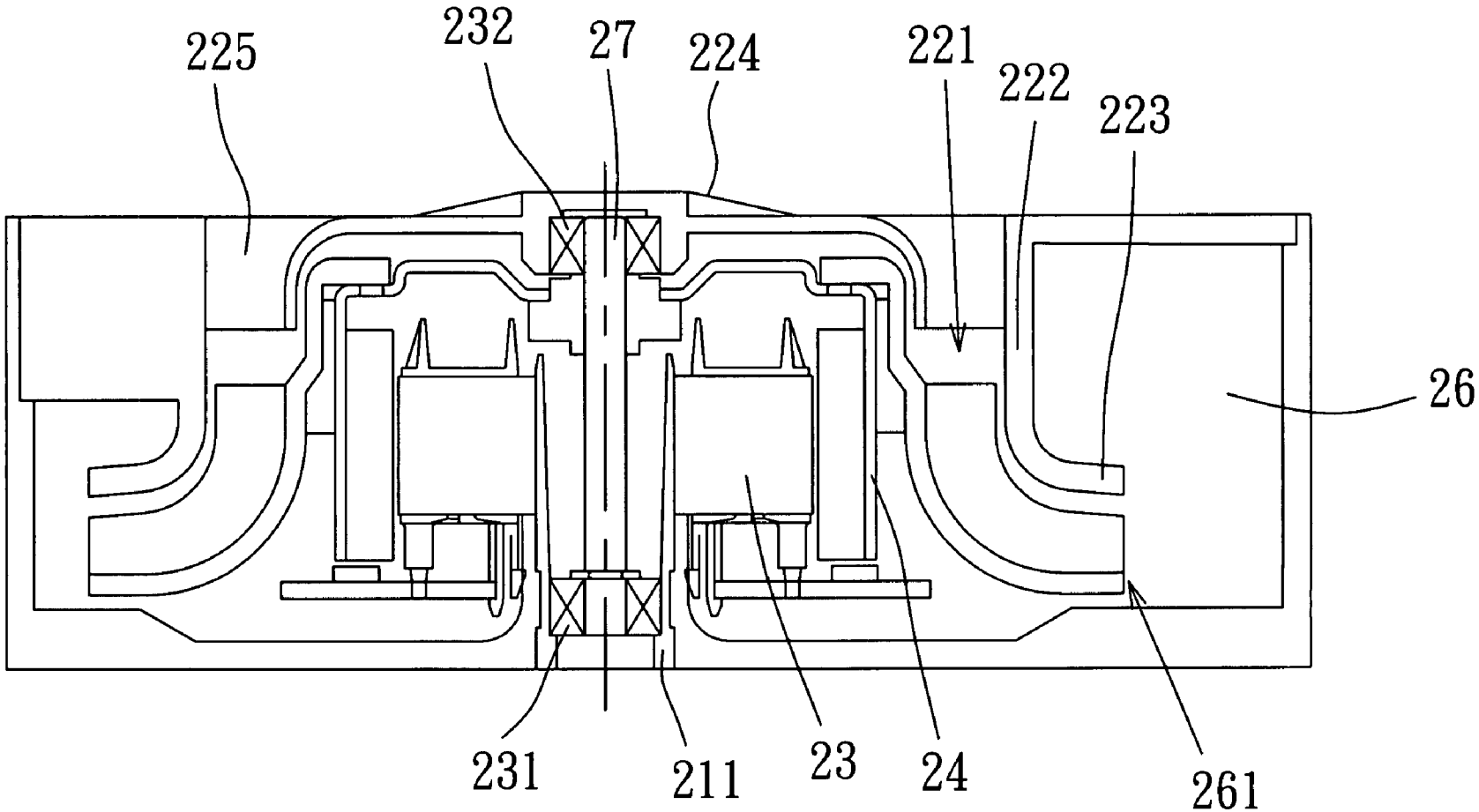
FIG. 2B is a sectional view of the heat-dissipating device of FIG. 2A after being assembled.
Figure 2C:
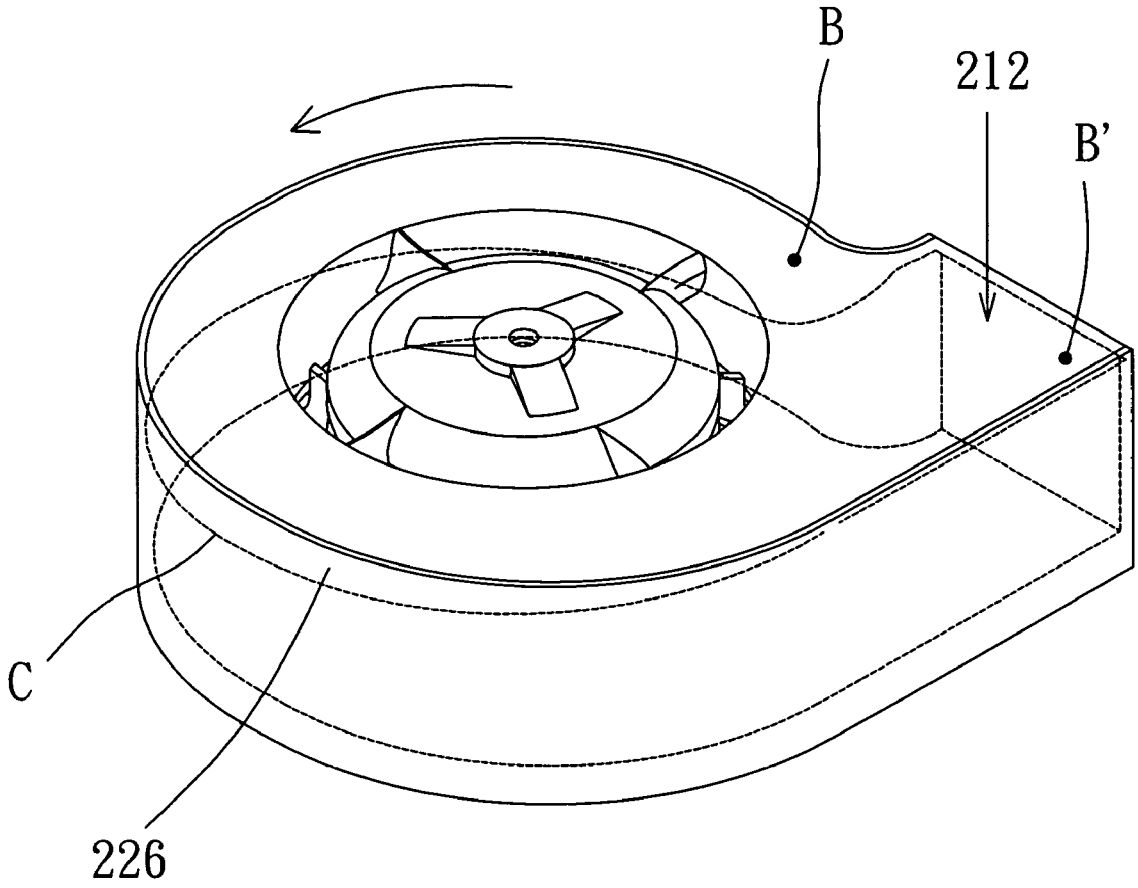
FIG. 2C is a perspective view of a heat-dissipating device of FIG. 2A after being assembled.

Please refer to FIGS. 2A~2C showing the first embodiment of the heat-dissipating device of the present invention. The heat-dissipating device is exemplified by a centrifugal fan, which is a single-suction blower. The heat-dissipating device includes a housing constituted by a first frame 21 and a second frame 22, a driving device 23, a metallic shell 24 and a rotor 25.

The first frame 21 includes a bearing tube 211 for receiving and supporting the driving device 23 and the bearing 231 is mounted inside the bearing tube 211 for supporting a rotating shaft 27 of the rotor 25. The second frame 22 includes an air inlet 221 and a sidewall 222 extending downward from an inner margin of the air inlet 221. When the first frame 21 and the second frame 22 are assembled together, a space will be formed inside the heat-dissipating device and can be divided to an air-gathering chamber 26 and a partition for disposing the rotor 25 therein by the sidewall 222. An air outlet 212 is also formed simultaneously as shown in FIG. 2C. A flange 223 is radially extending from the bottom of the sidewall 222 to define an entrance 261 of the air-gathering chamber 26.

The rotor 25 includes a hub 251, a base 252 radially extending from the bottom end of the hub 251, a first set of blades 253 and a second set of blades 254, and is driven by the driving device 23 coupled inside the hub 251. The first and second sets of blades 253, 254 are curved blades disposed on the base 252, respectively, and each blade has one end extending toward the entrance 261 of the air-gathering chamber 26, wherein the first set of blades is extended downward from the outer periphery of the hub 251 to the surface of the base 252. The first and second sets of blades are alternately arranged as shown in FIG. 2A. The hub 251, the base 252 and the blades 253, 254 can be integrally formed as a monolithic piece by injection molding.

The second frame 22 further has a support 224 mounted inside the air inlet and a plurality of air-guiding members 225 are disposed between the support 224 and the sidewall 222 for increasing the blast pressure of the heat-dissipating device. The number, shape and arrangement of the air-guiding members can be modified or selected according to the actual application. The plurality of air-guiding members can be shaped as strip, plate, curved, inclined or airfoil structures. In addition, if the aspect of the present invention is applied to an upside-down blower, a two-suction blower or an axial-flow fan, the air-guiding members can be disposed on one of the air inlets or both.

As the rotor 25 rotates, the airflow is intaked into the air inlet 221, passes through the air-guiding members 225 and the blades 253, 254, and is guided into the air-gathering chamber 26 via the entrance 261. In the air-gathering chamber 26, the airflow is gradually collected and discharged therefrom to the exterior at a high pressure via the air outlet 212, which can prevent the sudden change of the airflow pressure. Thus, the airflow sequentially passes through the air inlet 221, the air-guiding members 225, the blades 253, 254 and the entrance 261 of the air-gathering chamber 26.

Because the sidewall 222 extends downward from the inner margin of the air inlet 221 and separates the air-gathering chamber 26 from the rotor 25 and the size of the air outlet 212 is reduced, time of airflow pressurization by the rotor 25 is increased such that the variation in airflow pressure are stabilized. Further, because the height of the air-gathering chamber 26 partially or completely overlaps that of the flow passage through the rotor 25 and the air-guiding members 225 in the axial direction, the occupied space of the centrifugal fan can be minimized. The cross-sectional area of the air-gathering chamber 26 is substantially equal in size to that of the air outlet 212 such that airflow can constantly and stably flow within the air-gathering chamber 26 and the air outlet 212 to prevent work loss.

On the other hand, the present invention adopts a two-side motor fixed design, as shown in FIG. 2B, the bearing 231 is mounted inside the bearing tube 211 and the other bearing 232 is mounted on the inner side of the support 224 of the second frame 22 for jointly supporting the shaft 27 of the rotor 25 so as to provide the stabilization of the centrifugal fan under the high-speed operation and eliminate the vibration.

As shown in FIG. 2A or 2C, the second frame has an extending part 226 formed on an inner side thereof and axially extending toward the direction of the first frame to form an axially compressed airflow passage in the housing. The axially extending depth of the extending part 226 is gradually increased from the air outlet to the position far away from the air outlet. In other words, as shown in FIG. 2C, the axially extending depth of the extending part 226 is gradually decreased from the location B to the location B' along the counter clockwise direction and the variation in the axially extending depth is indicated by the dotted line C.

Figure 3:
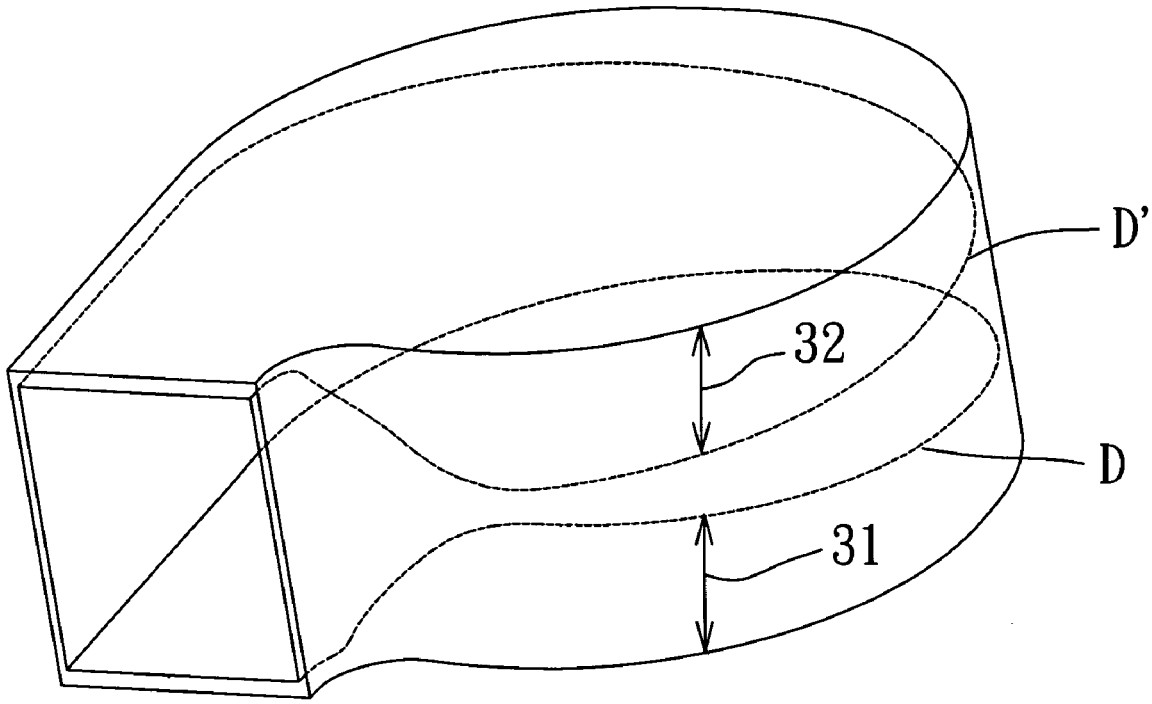
FIG. 3 is a schematic diagram of a heat-dissipating device with a two-side axially compressed air passage according to the present invention.

In addition to the above-described one-side axially compressed airflow passage, another two-side axially compressed airflow passage can also be adopted. As shown in FIG. 3, except the radially compressed airflow passage like the conventional blower, the first frame has a first extending part 31 extending upwardly toward the direction of the second frame, wherein the axially extending depth of the first extending part 31 is gradually decreased to almost become zero near the air outlet and its variation in the axially extending depth is indicated by the dotted line D. On the other hand, the second frame also has a second extending part 32 extending downwardly toward the direction of the first frame, wherein the axially extending depth of the second extending part 32 is gradually decreased to almost become zero near the air outlet and its variation in the axially extending depth is indicated by the dotted line D'. The first and second extending parts 31, 32 are formed in a mirror image configuration in the axial direction.

In conclusion, the present invention provides a heat-dissipating device utilizing an one-side or two-side axially compressed air passage for enabling the airflow to smoothly flow in the air passage inside the frame thereof so as to enhance its performance.

While the invention has been described in connection with what is presently considered to be the most practical and preferred embodiment, it is to be understood that the invention is not limited to the disclosed embodiments, but, on the contrary, is intended to accommodate various modifications and equivalent arrangements included within the spirit and scope of the appended claims.

What is claimed is:

1. A heat-dissipating device, comprising:

a housing having at least one air inlet and at least one air outlet; and a rotor disposed in the housing, wherein the housing comprises:

a first frame for accommodating the rotor therein; and a second frame coupled to the first frame, provided with the air inlet, and the second frame comprising a sidewall extending from a periphery of the air inlet to define an air-gathering chamber in the housing;

wherein the housing has a first extending part extending along an axial direction of the heat-dissipating device to form an axially compressed air passage inside the housing for changing an air pressure in the housing.

2. The heat-dissipating device of claim 1, wherein an axially extending depth of the first extending part is gradually increased from the air outlet to a position far away from the air outlet.

3. The heat-dissipating device of claim 1, wherein the housing further comprises a second extending part axially extending corresponding to the first extending part to form a two-side axially compressed air passage inside the housing.

4. The heat-dissipating device of claim 3, wherein an axially extending depth of the second extending part is gradually increased from the air outlet to a position far away from the air outlet.

5. The heat-dissipating device of claim 3, wherein an axially extending depth of the first or second extending part is gradually decreased to almost become zero near the air outlet.

6. The heat-dissipating device of claim 3, wherein the first and second extending parts are formed in a mirror image configuration in the axial direction.

7. The heat-dissipating device of claim 1, wherein the housing further comprises a radially compressed air passage inside the housing.

8. The heat-dissipating device of claim 1, wherein the rotor comprises a base, a hub, a first set of blades and a second set of blades.

9. The heat-dissipating device of claim 8, wherein the first set of blades extends from a periphery of the hub to a surface of the base and the second set of blades is disposed on the base.

10. The heat-dissipating device of claim 8, wherein the base, the hub, the first and second sets of blades are integrally formed as a single unit.

11. The heat-dissipating device of claim 1, wherein the sidewall has a flange radially extending from one end thereof to define an entrance of the air-gathering chamber, and each of the blades has an end extending toward the entrance of the air-gathering chamber for guiding the airflow into the air-gathering chamber.

12. The heat-dissipating device of claim 1, wherein the air-gathering chamber partially or completely overlaps an air passage through the rotor in height along an axis of the heat-dissipating device.

13. The heat-dissipating device of claim 1, wherein the second frame further comprises a plurality of air-guiding members disposed along the sidewall for increasing a blast pressure of airflow passing through the heat-dissipating device.

14. The heat-dissipating device of claim 13, wherein the second frame has a support mounted inside the air inlet and the plurality of air-guiding members are arranged between the sidewall and the support.

15. The heat-dissipating device of claim 13, wherein the plurality of air-guiding members are shaped as strip, plate, curved, inclined or airfoil structures.

16. The heat-dissipating device of claim 13, wherein the first frame has a bearing tube for allowing a first bearing to be disposed therein and the support of the second frame receives a second bearing so as to jointly support a shaft of the rotor with the first bearing.

17. A heat-dissipating device, comprising:

a housing having a first frame, a second frame, at least one air inlet and at least one air outlet; and a rotor disposed in the housing, wherein the first frame has a first extending part extending along an axial direction of the heat-dissipating device to form an axially compressed air passage inside the housing for changing an air pressure in the housing, and the second frame has a second extending part formed in a mirror image configuration in the axial direction.

18. The heat-dissipating device of claim 17, wherein the second extending part axially extending corresponding to the first extending part to form a two-side axially compressed air passage inside the housing.

19. The heat-dissipating device of claim 18, wherein an axially extending depth of the first or second extending part is gradually increased from the air outlet to a position far away from the air outlet.

20. The heat-dissipating device of claim 18, wherein an axially extending depth of the first or second extending part is gradually decreased to almost become zero near the air outlet.

* * * * *